US010905210B2

(12) United States Patent
Nowak

(10) Patent No.: US 10,905,210 B2
(45) Date of Patent: Feb. 2, 2021

(54) MULTI-COMPARTMENT PORTABLE STORAGE UNIT

(71) Applicant: Nick Nowak, Bryn Athyn, PA (US)

(72) Inventor: Nick Nowak, Bryn Athyn, PA (US)

( * ) Notice: Subject to any disclaimer, the term of this patent is extended or adjusted under 35 U.S.C. 154(b) by 0 days.

(21) Appl. No.: 15/958,168

(22) Filed: Apr. 20, 2018

(65) Prior Publication Data

US 2018/0303211 A1 Oct. 25, 2018

Related U.S. Application Data

(60) Provisional application No. 62/487,993, filed on Apr. 20, 2017.

(51) Int. Cl.

| | |
|---|---|
| ***A45C 13/02*** | (2006.01) |
| ***A45C 7/00*** | (2006.01) |
| ***A45F 3/04*** | (2006.01) |
| ***A45C 13/10*** | (2006.01) |
| ***A45C 13/00*** | (2006.01) |
| ***A45C 3/00*** | (2006.01) |
| ***A45C 3/08*** | (2006.01) |

(52) U.S. Cl.

CPC ..... *A45C 7/0086* (2013.01); *A45C 3/00* (2013.01); *A45C 3/001* (2013.01); *A45C 3/08* (2013.01); *A45C 13/008* (2013.01); *A45C 13/02* (2013.01); *A45C 13/1076* (2013.01); *A45F 3/04* (2013.01); *A45C 2003/007* (2013.01); *A45C 2013/026* (2013.01)

(58) Field of Classification Search

CPC ..... A45C 7/0086; A45C 13/008; A45C 2013/026; A45C 2003/007; A45C 3/00; A45C 3/001; A45C 3/08; A45C 13/02; A45C 13/1076; A45F 3/04

See application file for complete search history.

(56) References Cited

U.S. PATENT DOCUMENTS

| | | | | |
|---|---|---|---|---|
| 6,029,877 | A * | 2/2000 | Woods | A45C 13/02 224/236 |
| 6,435,392 | B1 * | 8/2002 | Kennedy | A45C 11/22 224/277 |
| 9,949,555 | B2 * | 4/2018 | Wu | A45F 3/005 |
| 2010/0316308 | A1 * | 12/2010 | Heinlen | B65D 31/04 383/25 |
| 2013/0243354 | A1 * | 9/2013 | Lytle | A45C 3/00 383/59 |
| 2014/0053960 | A1 * | 2/2014 | Johnson | A45C 3/06 150/113 |
| 2014/0069063 | A1 * | 3/2014 | Edmonds | A45C 3/00 53/473 |
| 2014/0339277 | A1 * | 11/2014 | Law | A45C 11/22 224/259 |
| 2018/0255893 | A1 * | 9/2018 | Godshaw | A45C 13/18 |

* cited by examiner

*Primary Examiner* — Corey N Skurdal
(74) *Attorney, Agent, or Firm* — Riverside Law, LLP

(57) ABSTRACT

The present invention provides a portable storage unit, comprising an external component, wherein the external component comprises an opening to an internal compartment, and an internal component, wherein the internal component and comprises an opening to an internal compartment, wherein the internal component is sized to fit within the internal compartment of the external component, wherein the internal component is removably attachable to the internal compartment of the external component.

10 Claims, 7 Drawing Sheets

MULTI-COMPARTMENT PORTABLE STORAGE UNIT

CROSS-REFERENCE TO RELATED APPLICATIONS

This application claims priority to U.S. provisional application No. 62/487,993 filed on Apr. 20, 2017 incorporated herein by reference in its entirety.

BACKGROUND OF THE INVENTION

Portable storage units come in many different designs, such as hand bags, back sacks, back packs, equipment bags, and the like. These units generally include flexible, collapsible compartments that can be used to store and carry a wide range of items, and can easily be carried over the shoulders of a user.

Despite the various designs of portable storage units for carrying items for hikes, sporting events and the like, there is a need for a storage unit with lightweight and portable features that also can provide a secure and waterproof place to store personal items. There also exists a need for a portable storage unit that has lightweight, over-the-shoulder features and also offers insulated compartments for safe-keeping temperature-sensitive items. The storage unit of the present invention provides for these unmet needs.

SUMMARY OF THE INVENTION

The present invention relates to a portable storage unit that includes an external component, wherein the external component includes an opening to an internal compartment, and an internal component, wherein the internal component and includes an opening to an internal compartment, wherein the internal component is sized to fit within the internal compartment of the external component wherein the internal component is removably attachable to the internal compartment of the external component.

In some embodiments, the internal component is removably attachable to the external component via snaps. In some embodiments, the internal component is removably attachable to the external component via buttons. In some embodiments, the internal component is removably attachable to the external component via clips.

In some embodiments, the internal component is constructed of material wherein the material is waterproof. In some embodiments, the material is selected from the group consisting of: polyamide, polypropylene, rayon polyester, polyethylene, polyethylene terephthalate, elastane, spandex, lycra, a polyurethane-polyurea copolymer such as thermoplastic polyurethane, polyvinyl chloride, or a combination thereof.

In some embodiments, the opening of the internal component is releasably sealed via a roll-and-snap seal. In some embodiments, the opening of the internal component is releasably sealed via a zipper. In some embodiments, the internal component comprises one or more storage compartments.

In some embodiments, the external component constructed of material wherein the material is selected from the group consisting of: polyamide, polypropylene, rayon polyester, polyethylene, polyethylene terephthalate, elastane, spandex, lycra, a polyurethane-polyurea copolymer such as thermoplastic polyurethane, polyvinyl chloride, polyvinyl chloride-coated mesh, other mesh material, or a combination thereof.

In some embodiments, the external component comprises one or more storage compartments. In some embodiments, the opening of the external component releasable seals via a drawstring.

In some embodiments, the unit comprises one or more straps for carrying the unit.

DETAILED DESCRIPTION

The present invention relates to a multi-component portable storage unit that includes internal and external storage bags, where the internal bag is removably attached to an internal carrying compartment of the external bag. At least the internal bag has one or more compartments that are waterproof and/or can insulate from widely ranging temperatures.

Definitions

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are described.

As used herein, each of the following terms has the meaning associated with it in this section.

The articles "a" and "an" are used herein to refer to one or to more than one (i.e., to at least one) of the grammatical object of the article. By way of example, "an element" means one element or more than one element.

"About" as used herein when referring to a measurable value such as an amount, a temporal duration, and the like, is meant to encompass variations of ±20%, ±10%, ±5%, ±1%, or ±0.1% from the specified value, as such variations are appropriate to perform the disclosed methods.

Ranges: throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Description

Figure 1A:
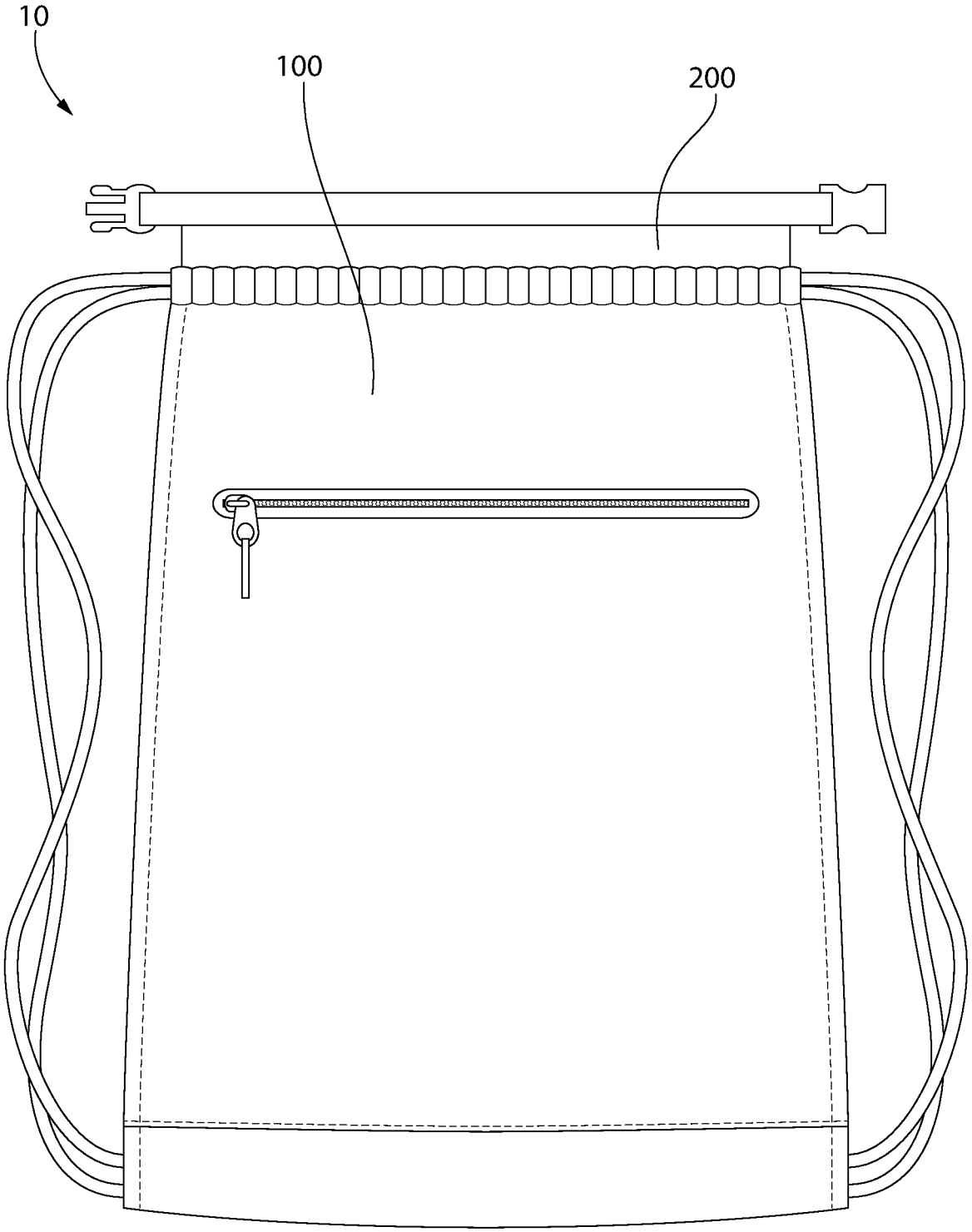
FIG. 1A through FIG. 1C depicts exemplary assembled multi-component portable storage units.
Figure 1B:
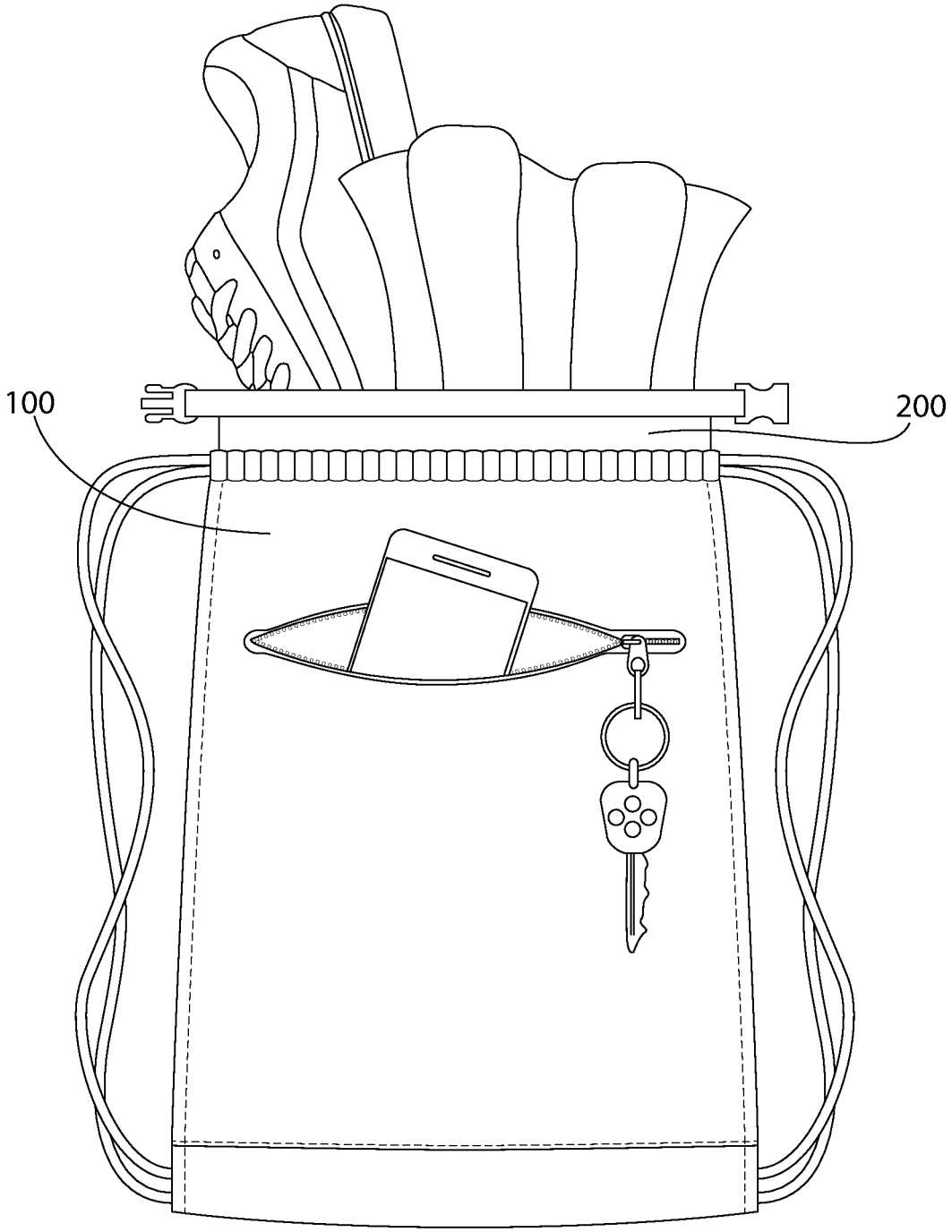
Figure 1C:
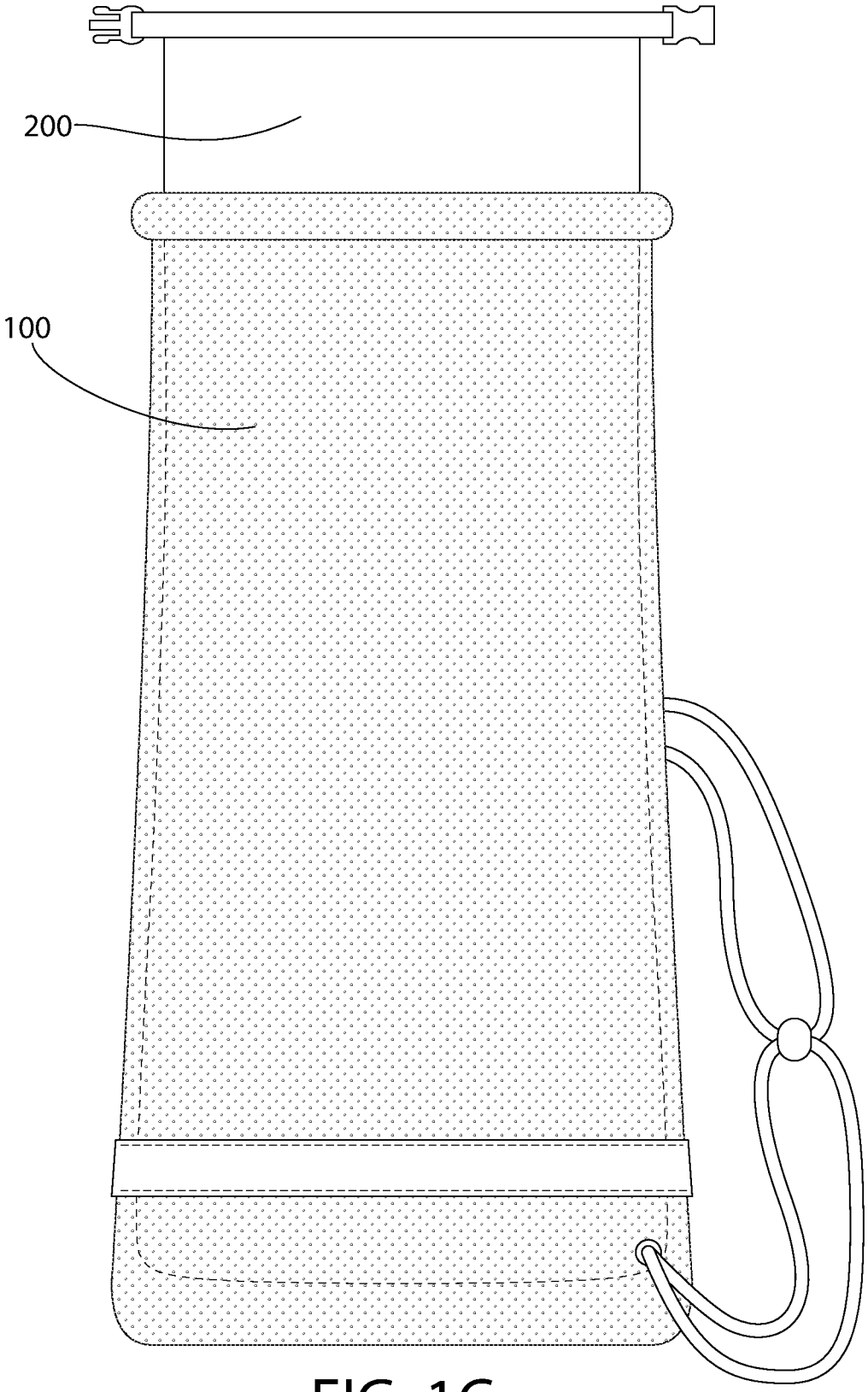

The present invention relates to a multi-component portable storage unit wherein the storage unit comprises an internal component (or bag) and an external component (or bag). As shown in FIGS. 1A-1C, multi-component storage unit 10 comprises external component 100, and internal component 200 which removably attaches to an inner compartment of external component 100. In some embodiments, external component 100 functions independently as a portable storage unit. In some embodiments, internal component 200 functions independently as a portable storage unit. In some embodiments, the combination of external component 100 and internal component 200 forming multi-component portably storage unit 10 functions as a portable storage unit.

Referring now to FIG. 2, external component 100 comprises a bag with one open edge forming opening 101 with enclosure unit 110, and three sealed edges 104 to form a central internal compartment accessible via opening 101. External component 100 further comprises one or more storage pockets 120, an optionally reinforced base 130, internal attachment units 135 (FIG. 3), and shoulder straps 140. The three sealed edges 104 of external component 100 are sealed by means known to one skilled in the art, for example, sewing, stitching, fusing, sealing, folding or the like.

Figure 2A:
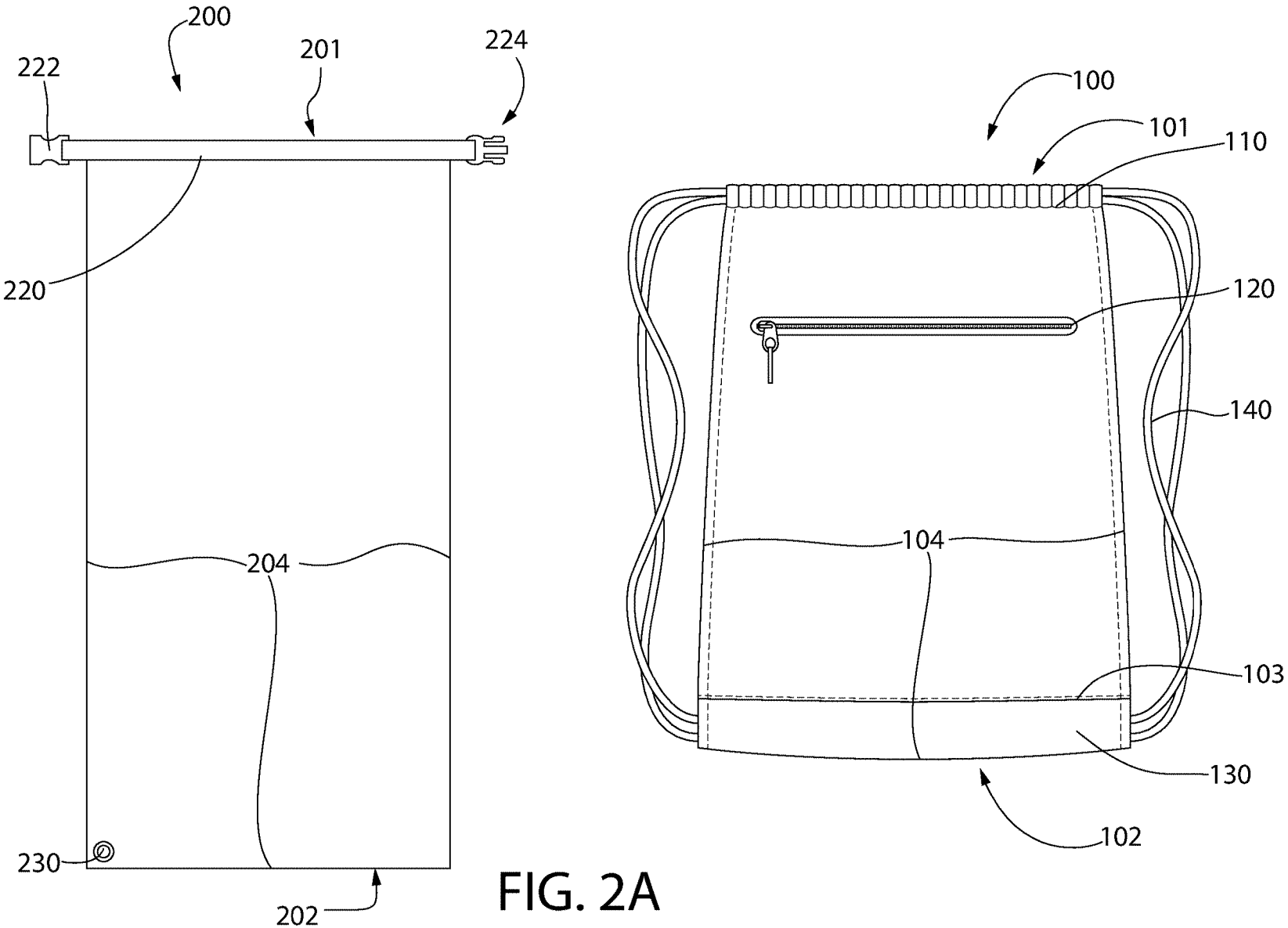
FIG. 2A through FIG. 2C depicts exemplary disassembled multi-component portable storage units.
Figure 2B:
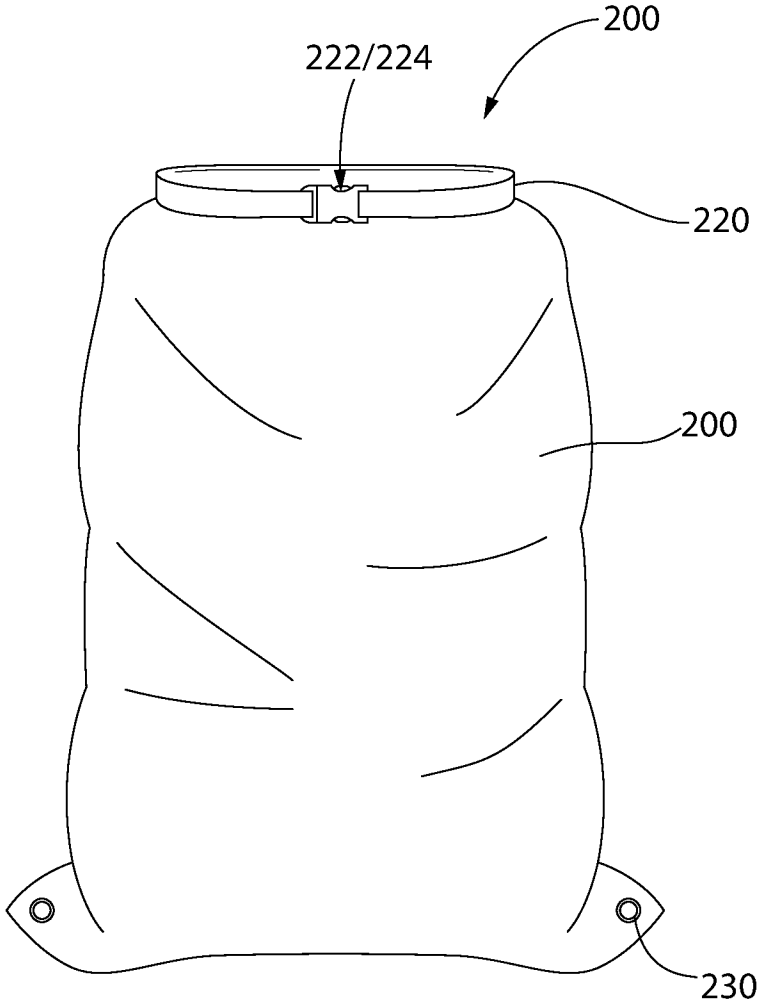
Figure 2B:
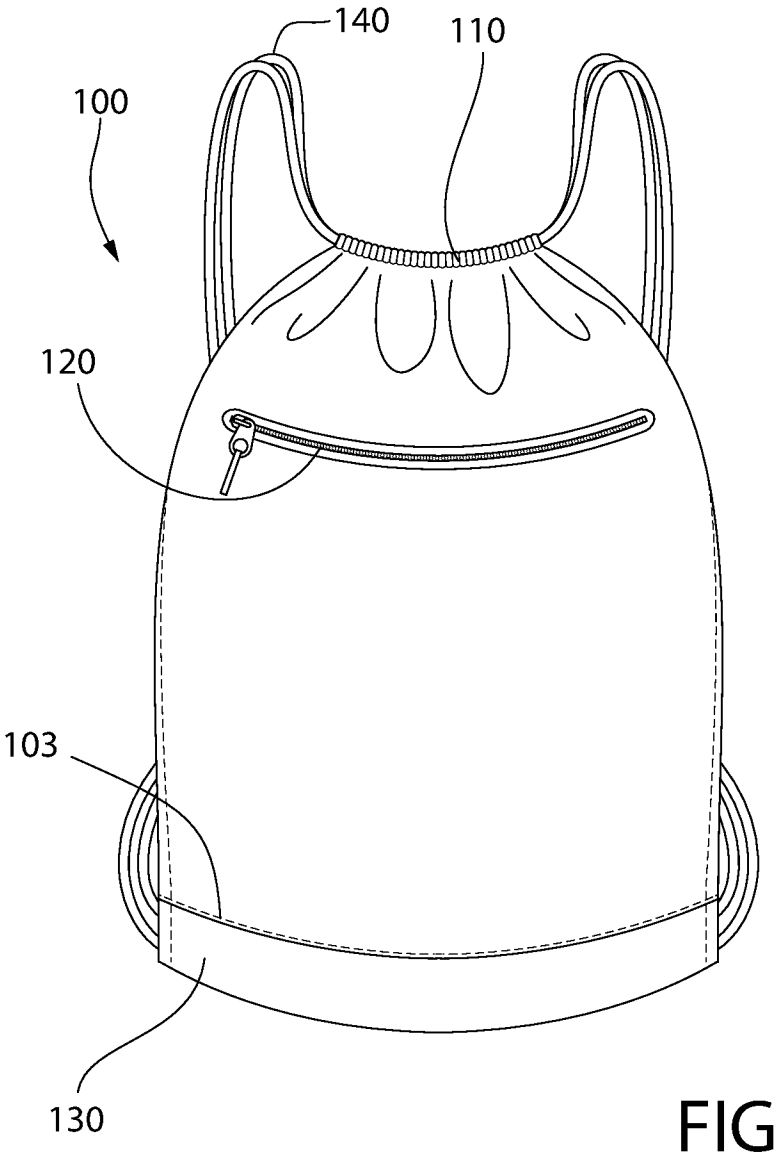
Figure 2C:
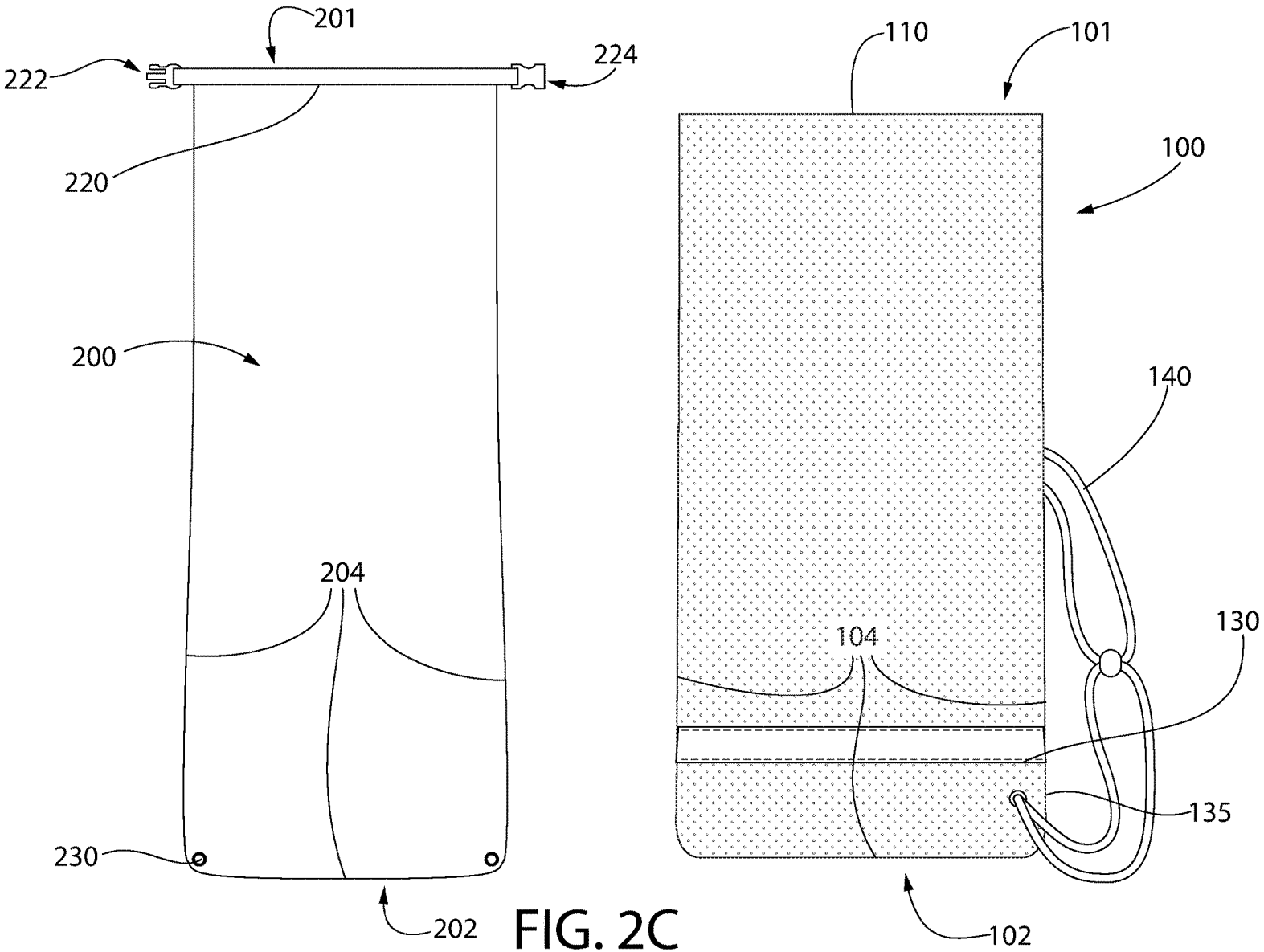
Figure 3A:
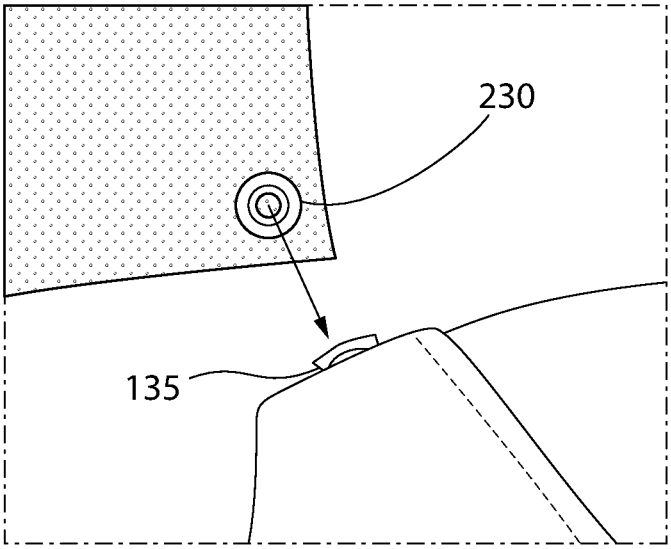
FIG. 3A and FIG. 3B depicts both disengaged (FIG. 3A) and engaged (FIG. 3B) configurations of an exemplary attachment unit on the internal surface of the internal compartment of the external component of the portable storage unit interacting with the reciprocal anchoring unit on the external surface of the internal component of the portable storage unit where the external component is inverted to show the attachment unit on its internal surface.
Figure 3B:
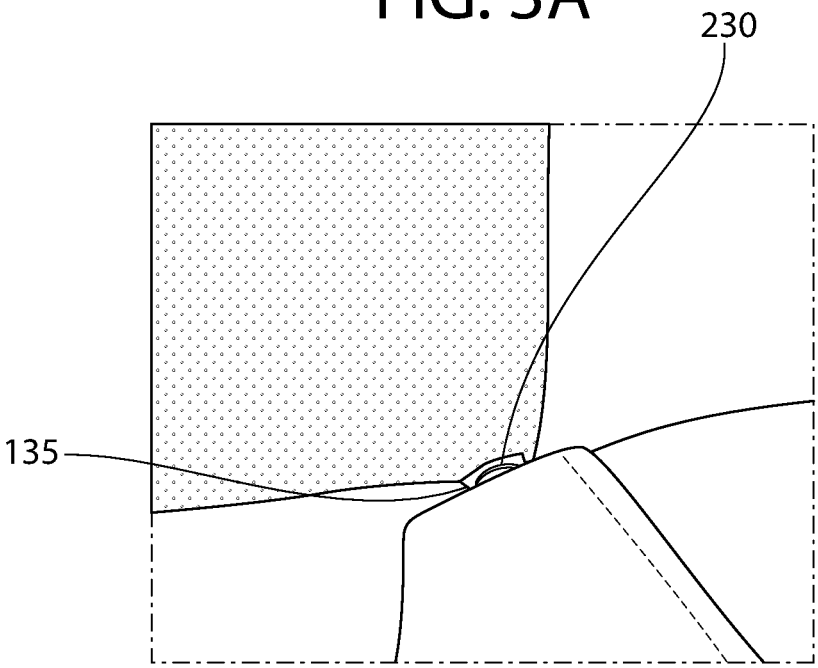

External component 100 further comprises optionally rigid base 130. In some embodiments, base 130 is optionally reinforced with one or more optionally rigid layers of material. In some embodiments, base 130 is constructed of a single layer of sturdy or rigid material. External component 100 is constructed of any suitable durable material known to one skilled in the art, for example, woven or non-woven, synthetic, natural, post-consumer recycled, virgin, or a combination thereof textile. In some embodiments, base 130 is constructed from the same material as the body of external component 100. In some embodiments, base 130 is constructed from different material than the body of external component 100 and sealingly attached to the body of external component along seam 103 by means known to one skilled in the art, for example stitching, sewing, fusing, sealing, and the like. In some embodiments, external component 100 is constructed of a solid or continuous material, as shown in FIG. 1A and FIG. 2A. In some embodiments, external component 100 is constructed of a porous or mesh material, as shown in FIG. 1C and FIG. 2C. In some embodiments, external component 100 is constructed of material comprising woven or non-woven, synthetic, natural, post-consumer recycled, virgin, or a combination thereof textile. For example, polyamide, polypropylene, rayon polyester, polyethylene, polyethylene terephthalate, elastane, spandex, lycra, a polyurethane-polyurea copolymer such as thermoplastic polyurethane, polyvinyl chloride, polyvinyl chloride-coated mesh, other mesh material, or a combination thereof. In some embodiments, base 130 is constructed from woven or non-woven, synthetic, natural, post-consumer recycled, virgin, or a combination thereof textile. For example, polyamide, polypropylene, rayon polyester, polyethylene, polyethylene terephthalate, elastane, spandex, lycra, a polyurethane-polyurea copolymer such as thermoplastic polyurethane, or a combination thereof. In some embodiments, base 130 is optionally reinforced with one or more layers of construction material mentioned herein. In some embodiments, base 130 is optionally reinforced with rigid material such as a plastic or similar material known in the art that is optionally removably inserted between layers of construction material mentioned herein.

Now referring to opening 101 of external component 100, opening 101 comprises enclosure unit 110. As shown in FIG. 2B, external component 100 can be releasably closed in any suitable manner known to one skilled in the art using enclosure unit 110. In some embodiments, enclosure unit 110 comprises one or more drawstrings, clips, cinches, zippers, snaps and the like. External component 100 further comprises one or more shoulder straps 140. In some embodiments, straps 140 are securely attached to external component 100 at one or more location on the surface of external component 100. In some embodiments, straps 140 are a part of enclosure unit 110 wherein straps 140 are the drawstrings of enclosure unit 110 and securely attach to the external surface of external component 100.

External component 100 further comprises one or more storage pockets 120. In some embodiments, one or more storage pockets 120 are located on the external surface of component 100 forming a pocket with access preferably from the outside, but optionally also from the inside of external component 100. In some embodiments, one or more storage pockets 120 are located on the internal surface of component 100 forming a pocket preferably with access from the inside, but optionally from the outside of external component 100. In some embodiments, one or more storage pockets 120 are optionally sealable using a mechanism known to one skilled in the art, such as a zipper, buttons, snaps, press-and-seal, and the like. In some embodiments, pocket 120 is not sealed.

External component 100 further comprises one or more internal attachment units 135 (FIGS. 3A-3B) for attaching internal component 200 to external component 100. One or more attachment units 135 can be positioned in any suitable location on the surface of external component 100. In some embodiments, attachment units 135 can be positioned on the internal or external surface of external component 100, but preferably within the central internal compartment of external component 100. In some embodiments, attachment units 135 can be any suitable removably attaching component, such as snaps, buttons, cinches, hook-and-loop fasteners, touch fasteners, other fasteners or the like attached to the internal compartment of external component by means known to one skilled in the art such as stitching, gluing, fusing, riveting, and the like. In some embodiments, attachment units 135 can be any suitable permanent attaching components, such as stitching, gluing material, fusing material, and the like.

Now referring to internal component 200, as depicted in FIGS. 2A-2C, internal component 200 comprises a bag with one open edge 201, and three sealed edges 204. Internal component 200 further comprises closure 220 at opening 201 comprising female closure unit 222 and male closure unit 224. Female closure unit 222 and male closure unit 224 of closure 220 can be any suitable complementing attaching system known in the art such as interlocking clips, roll-and clip system, buckles, snaps, fasteners, drawstring, zipper, press-and-seal system, and the like. As shown in FIG. 2B, in one embodiment, open edge 201 can be rolled in a manner sealing open edge 201, and secured by engaging closure units 222 and 224 securing open edge 201 in a closed configuration.

Additionally, the exterior surface of internal component 200 comprises one or more anchoring units 230. In some embodiments, anchoring units 230 removably attach inner component 200 to outer component 100. In some embodiments, anchoring units 230 permanently attach inner component 200 to outer component 100. Anchoring units 230 can be any suitable anchoring components known to one skilled in the art such as snaps, buttons, cinches, hook-and-loop fasteners, touch fasteners, other fasteners, stitching, gluing material, fusing material, and the like that reciprocally engage attachment units 135 of external component 100.

In some embodiments, internal component 200 is a one compartment enclosure. In some embodiments, internal component 200 is a multi-compartment enclosure wherein internal component 200 comprises one or more dividers forming one or more compartments (not shown). In some embodiments, internal component 200 has one or more optionally sealable storage pockets (not shown). In some embodiments, one or more storage pockets are located on the external surface of component 200 forming a pocket with access preferably from the outside, but optionally also from the inside of internal component 200. In some embodiments, one or more storage pockets are located on the internal surface of component 200 forming a pocket preferably with access from the inside, but optionally from the outside of internal component 200. In some embodiments, one or more storage pockets are optionally sealable using means known in the art, such as a zipper, buttons, snaps, press-and-seal, and the like. In some embodiments, pocket is not sealed.

Internal component 200 is constructed from one or more layers of material comprising woven or non-woven, synthetic, natural, post-consumer recycled, virgin, or a combination thereof textile. For example, polyamide, polypropylene, rayon polyester, polyethylene, polyethylene terephthalate, elastane, spandex, lycra, a polyurethane-polyurea copolymer such as thermoplastic polyurethane, or a combination thereof. In some embodiments, internal component 200 is constructed from material that has optionally been treated with a waterproofing material known in the art such as polytetrafluoroethylene, polyvinyl chloride, or the like.

The disclosures of each and every patent, patent application, and publication cited herein are hereby incorporated herein by reference in their entirety. While this invention has been disclosed with reference to specific embodiments, it is apparent that other embodiments and variations of this invention may be devised by others skilled in the art without departing from the true spirit and scope of the invention. The appended claims are intended to be construed to include all such embodiments and equivalent variations.

What is claimed is:

1. A portable storage unit, comprising an external component, wherein the external component comprises an opening to an internal compartment and a first attachment mechanism is configured at a bottom portion of the internal compartment, and an internal component, wherein the internal component and comprises an opening to an internal compartment, wherein the internal component is sized to fit within the internal compartment of the external component and a second attachment mechanism configured to interface with the first attachment mechanism is configured at a bottom portion of the internal component defining a first and second open-top compartment between the internal component and the external component above the bottom portions on opposing sides of the internal component, wherein the internal component is removably attachable to the internal compartment of the external component, wherein the internal component is taller than the external component, and wherein the internal component is constructed of a waterproof material and the external component is constructed of a porous material.

2. The unit of claim 1, wherein the internal component is removably attachable to the external component via snaps.

3. The unit of claim 1, wherein the internal component is removably attachable to the external component via buttons.

4. The unit of claim 1, wherein the internal component is removably attachable to the external component via clips.

5. The unit of claim 1, wherein the material is selected from the group consisting of: polyamide, polypropylene, rayon polyester, polyethylene, polyethylene terephthalate, elastane, spandex, lycra, a polyurethane-polyurea copolymer such as thermoplastic polyurethane, polyvinyl chloride, or a combination thereof.

6. The unit of claim 1, wherein the opening of the internal component is releasably sealed via a roll-and-snap seal.

7. The unit of claim 1, wherein the opening of the internal component is releasably sealed via a zipper.

8. The unit of claim 1, wherein the external component constructed of material wherein the material is selected from the group consisting of: polyamide, polypropylene, rayon polyester, polyethylene, polyethylene terephthalate, elastane, spandex, lycra, a polyurethane-polyurea copolymer such as thermoplastic polyurethane, polyvinyl chloride, polyvinyl chloride-coated mesh, other mesh material, or a combination thereof.

9. The unit of claim 1, wherein the opening of the external component releasable seals via a drawstring.

10. The unit of claim 1, wherein the unit comprises one or more straps for carrying the unit.

* * * * *